US006206296B1

(12) United States Patent
Suzuki et al.

(10) Patent No.: US 6,206,296 B1
(45) Date of Patent: Mar. 27, 2001

(54) ROTOR FOR HEAT GENERATORS AND ITS MANUFACTURING METHOD

(75) Inventors: Shigeru Suzuki; Takashi Ban; Tatsuya Hirose; Tatsuyuki Hoshino; Hidefumi Mori, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/325,960

(22) Filed: Jun. 4, 1999

(30) Foreign Application Priority Data

Jun. 8, 1998 (JP) ..... 10-159278
Nov. 4, 1998 (JP) ..... 10-313633

(51) Int. Cl.[7] ..... B60H 1/02
(52) U.S. Cl. ..... 237/12.3 R; 122/26; 126/247
(58) Field of Search ..... 237/12.3 B, 12.3 R; 122/26; 126/247; 123/142.5 R

(56) References Cited

U.S. PATENT DOCUMENTS 4,388,042 * 6/1983 Weber ..... 416/198 A
4,813,342 * 3/1989 Schneider et al. ..... 92/207
5,573,184 11/1996 Martin .
5,915,341 * 6/1999 Moroi et al. ..... 122/26
6,026,767 * 2/2000 Moroi et al. ..... 122/26
6,056,520 * 5/2000 Nguyen et al. ..... 417/420

FOREIGN PATENT DOCUMENTS 9-323534 12/1997 (JP) .
10-217757 8/1998 (JP) .

* cited by examiner

*Primary Examiner*—Harold Joyce
*Assistant Examiner*—Derek S. Boles
(74) *Attorney, Agent, or Firm*—Morgan & Finnegan, LLP

(57) ABSTRACT

A method for producing a rotor assembly of a heat generator. The rotor assembly includes an inner rotor and an outer rotor that is rotated integrally with the inner rotor. The producing method includes forming the inner rotor from iron or iron alloy, and casting the outer rotor around the inner rotor by aluminum or aluminum alloy so that the outer rotor is firmly fixed to the inner rotor without slippage when heated.

28 Claims, 7 Drawing Sheets

ROTOR FOR HEAT GENERATORS AND ITS MANUFACTURING METHOD

BACKGROUND OF THE INVENTION

The present invention relates to a heater that generates heat by shearing viscous fluid. More specifically, the present invention relates to a method for securing a rotor for shearing viscous fluid to a shaft.

Various heaters that use the driving force of vehicle engines have been proposed as an auxiliary heater in a vehicle air conditioning system. Japanese Unexamined Patent Publication No. 10-217757 describes a heater that has a rotor and silicone oil, which are accommodated in a heating chamber defined in a housing of the heater. The rotor attached to a drive shaft is driven by an engine of the vehicle. When the driving force of the engine rotates the rotor, the silicone oil is heated from fluid friction. The heat of the oil is transferred to a coolant (heat transferring medium) in a heat transfer chamber adjacent to the heating chamber. Then, the coolant is sent to heating circuit and used for heating the passenger compartment.

In conventional heaters, the drive shaft is usually made of iron or iron alloy for its high hardness. On the other hand, the rotor is made of aluminum or aluminum alloy, which is light and easy to form. The coefficient of thermal expansion of aluminum or aluminum alloy is greater than that of iron or iron alloy. Therefore, when the rotor and the shaft are heated, the rotor expands more than the shaft, and this may loosen the fixation between them. If the rotor is not rigidly secured to the shaft, slipping occurs between them, thus lowering efficiency of heat generation. As a result, the heater may not generate enough heat for heating the passenger compartment. Usually, considering the difference of the thermal expansion between aluminum and iron, the rotor is formed to have interference with respect to the drive shaft. Furthermore, a thick boss is formed on the rotor to contact the drive shaft.

When attaching the rotor to the drive shaft, the following problems occurs.

When the predetermined interference between the rotor and the shaft is too small, the tightening force of the rotor against the drive shaft is weakened by heating. This causes slippage between the rotor and the drive shaft. Further, when using a cylindrical rotor, the space between the outer surface of the rotor and the inner wall of the heating chamber varies according to the temperature. To minimize the variation, the walls of the heating chamber are made of the same material as the rotor.

When the predetermined interference between the rotor and the drive shaft is too great, the force required to attach the rotor to the drive shaft is beyond the tension strength of the rotor, and this is likely to crack or break the rotor.

Thus, the interference between the rotor and the shaft must be determined very carefully, and the dimensions of the rotor must be strictly managed in manufacturing the rotor.

In particular, when positioning the rotor on the drive shaft relatively far from its ends, the rotor is more likely to crack or break. The rotor receives great resistance when being fitted to the drive shaft. The longer the distance from one end of the driveshaft to the target position, the more difficult it is to position the rotor. To facilitate the attachment of the rotor, lubricant is applied to the boss of the rotor. However, when the distance from the end of the drive shaft to the target position is long, the film of lubricant does not extend far enough, which may cause the rotor to break.

Another problem relates to the axial length of the part of the rotor contacting the drive shaft. The longer the length of contact is, the more likely it is that the force of the rotor against the drive shaft will vary axially. The part of the rotor having a stronger tightening force transmits the torque of the drive shaft. Therefore, the variation of the tightening force is likely to cause mechanical fatigue at the location where the stronger force is applied.

On the other hand, Unexamined Japanese Publication No. 9-323534 describes another heater having different means for preventing loosening of the rotor with respect to the drive shaft. In the heater of this Publication, the rotor includes an adapter that is fixed to the rotor with rivets. The adapter is joined to the drive shaft by splines. However, additional parts such as rivets are necessary to fix the adapter to the rotor. This increases the number of parts and the cost of the products.

SUMMARY OF THE INVENTION

The objective of the present invention is to provide a method for firmly fixing a rotor to a drive shaft, to provide a firmly fixed rotor and drive shaft assembly and a heater including such an assembly.

To achieve the above objective, the present invention provides a method for producing a rotor assembly of a heat generator. The rotor assembly includes an inner rotor and an outer rotor that is rotated integrally with the inner rotor. The producing method includes forming the inner rotor from iron or iron alloy, and casting the outer rotor around the inner rotor by aluminum or aluminum alloy.

The present invention further provides a rotor assembly for shearing viscous fluid to heat the viscous fluid in a heat generator. The heat generator has a housing and a heating chamber defined in the housing. The heating chamber accommodates the rotor assembly and the viscous fluid. The rotor assembly has an inner rotor and an outer rotor. The outer rotor is integrally attached with the inner rotor by casting. The inner rotor is made of iron or iron alloy. The outer rotor is made of aluminum or aluminum alloy, which has a thermal expansion coefficient greater than that of the iron or iron alloy.

The present invention further provides a heat generator for generating heat by shearing viscous fluid. The heat generator includes a housing, a heating chamber defined in the housing, viscous fluid accommodated in the heating chamber and a rotor assembly for shearing the viscous fluid to heat the viscous fluid. The rotor assembly includes an inner rotor and an outer rotor. The outer rotor is integrally attached with the inner rotor by casting. The inner rotor is made of iron or iron alloy. The outer rotor is made of aluminum or aluminum alloy, which has a thermal expansion coefficient greater than that of the iron or iron alloy.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A heater according to a first embodiment of the present invention will now be described with reference to FIGS. 1–3. The heater is built in a vehicle heating system.

Figure 1:
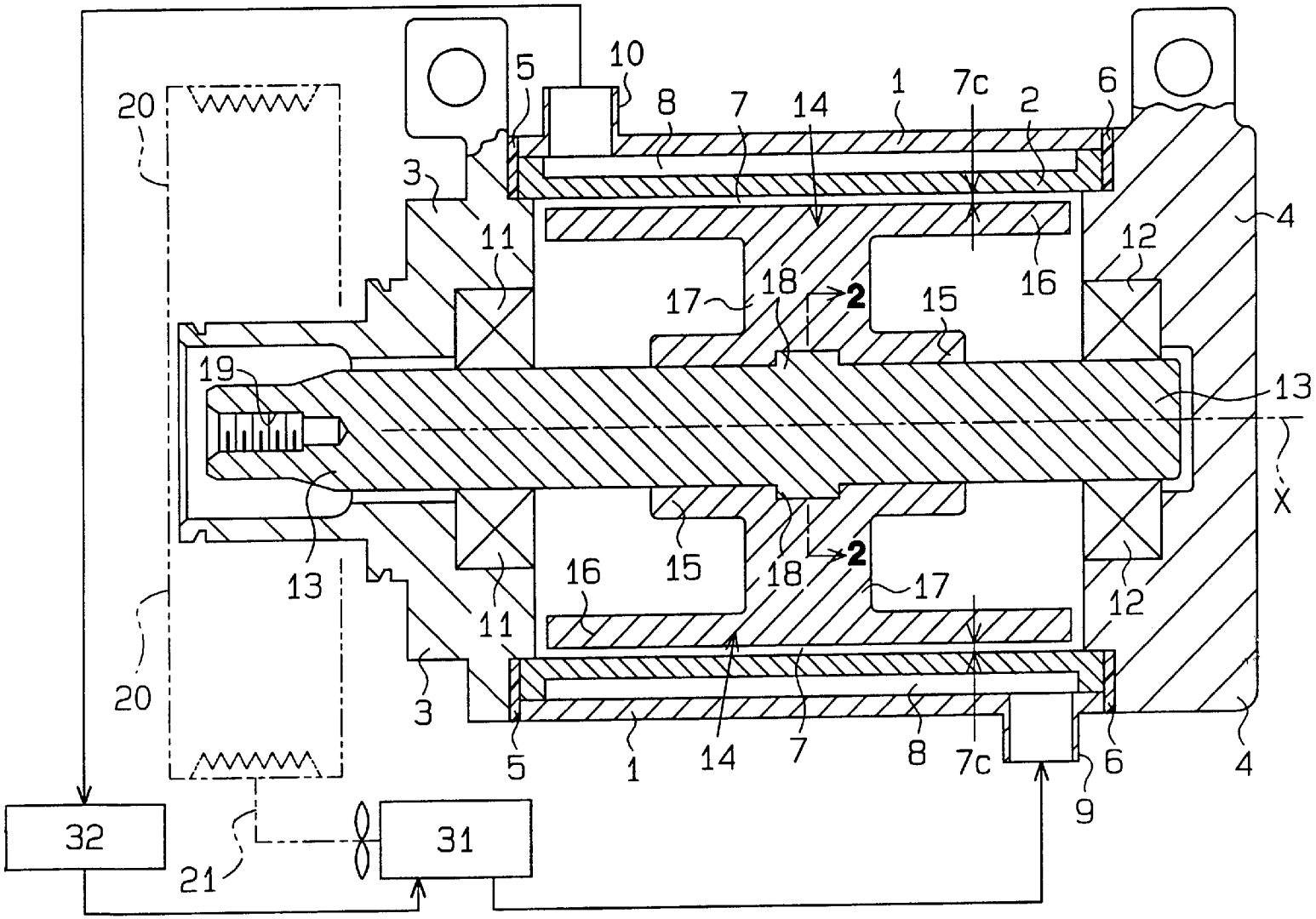
FIG. 1 is a cross sectional view of a heater according to a first embodiment of the present invention.

As shown in FIG. 1, the heater includes a center housing 1, a cylindrical partition 2, a front housing 3, and a rear housing 4. The center housing 1 accommodates the cylindrical partition 2. The front housing 3 is coupled to the front (left in FIG. 1) ends of the center housing 1 and the partition 2 through an annular seal 5. The rear housing 4 is coupled to the rear (right in FIG. 1) ends of the center housing 1 and the partition 2 through an annular seal 6. A plurality of bolts (not shown) fasten the center housing 1, the partition 2, the front housing 3, and the rear housing 4 together.

A heating chamber 7 is defined by the front housing 3, the rear housing 4, and the partition 2. A heat exchange chamber 8 is defined between the outer surface of the partition 2 and the inner surface of the center housing 1. The heat exchange chamber 8 surrounds the heating chamber 7.

As shown in FIG. 1, the center housing 1 includes an inlet port 9 and an outlet port 10. The inlet port 9 is located at the bottom of the center housing 1, and the outlet port 10 is located at the top of the center housing 1. A vehicle heating system includes an engine 31, the heater, and a heating circuit 32. An engine coolant (heat transferring medium) circulates through the engine 31, the heater, and the heating circuit 32. The coolant flows to the heat exchange chamber 8 through the inlet port 9. Then, the coolant heated in the heat exchange chamber 8 is sent to the heating circuit 32 through the outlet port 10.

A drive shaft, or inner rotor 13, is supported in the front housing 3 and the rear housing 4 through a front bearing 11 and a rear bearing 12. The bearings 11, 12 include seals. The bearing 11 is located between the front housing 3 and the outer surface of the inner rotor 13 and seals the front of the heating chamber 7. The bearing 12 is located between the rear housing 4 and the outer surface of the inner rotor 13 and seals the rear of the heating chamber 7. Thus, the heating chamber is formed as a sealed space in the heater housing.

As shown in FIG. 1, an outer rotor 14 is fixed to the inner rotor 13. The outer rotor 14 is generally cylindrical and includes a boss 15, a cylindrical portion 16, and a connecting portion 17. The cylindrical portion 16 is formed to surround the boss 15 and is spaced uniformly from the axis X of the inner rotor 13. The connecting portion 17 connects the center portion of the boss 15 to the center portion of the cylindrical portion 16. The outer rotor 14 is integrally formed with the inner rotor 13 by casting. The method of casting the rotor to the inner rotor 13 will be described later.

Figure 2:
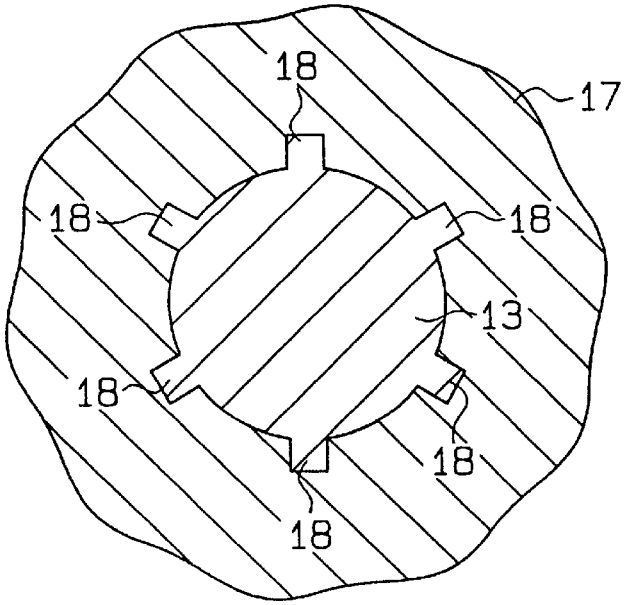
FIG. 2 is a cross sectional view taken along line 2—2 of FIG. 1.
Figure 3:
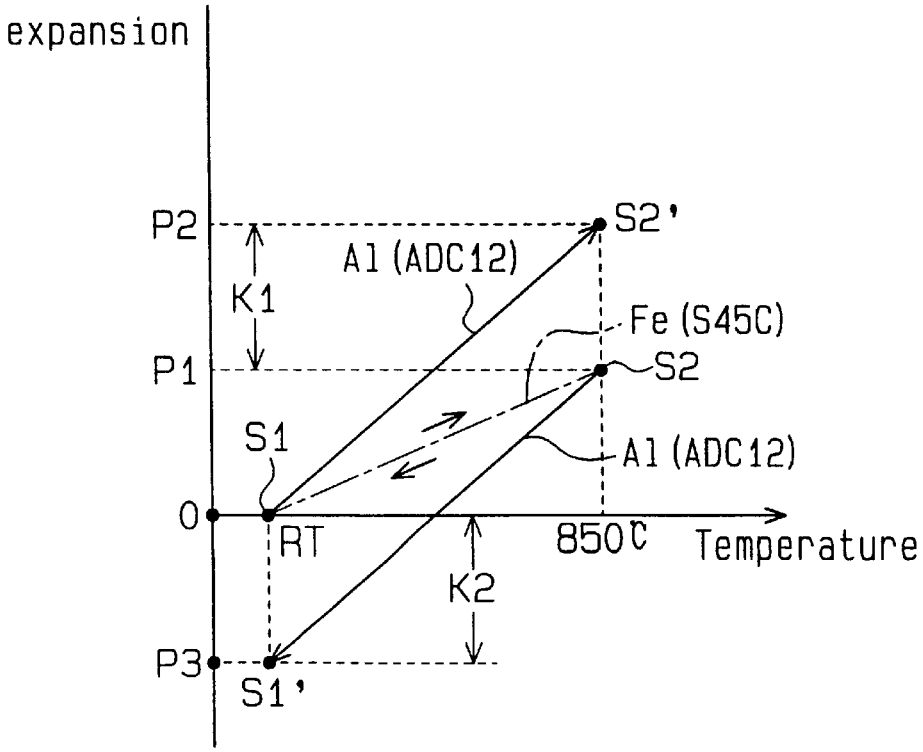
FIG. 3 is a graph showing the relation between expansion and the temperature with regard to a medium carbon steel (S45C) and an aluminum alloy (ADC12)

As shown in FIGS. 1 and 2, six projections 18 extend radially from the outer surface of the inner rotor 13. The projections 18 are spaced at equal distances from one another and contact the boss 15.

The shape of the heating chamber 7 substantially corresponds to the peripheral shape of the cylindrical portion 16. The inner wall of the heating chamber 7 is spaced from the outer surface of the cylindrical portion 16 by a clearance 7*c*. The radial dimension of the clearance 7*c* is within the range from 10 $\mu$m to 1 mm.

A predetermined amount of a viscous fluid, such as silicone oil, is charged in the heating chamber 7. The amount of the silicone oil is determined to be 60 to 90 percent of the volume of the heating chamber 7, which excludes the volumes of the inner rotor 13 and the outer rotor 14. Since the viscous fluid expands as the temperature increases, the amount of the viscous fluid charged is smaller than the volume of the heating chamber 7.

As shown in FIG. 1, a screw hole 19 is formed in the front end of the inner rotor 13. A pulley 20 (shown by broken line in FIG. 1) is secured to the front end with a bolt (not shown) . The pulley 20 is connected to the engine 31 through a V belt 21 (shown by broken line). The engine 31 rotates the inner rotor 13 and the rotor 14 through the pulley 20, thus shearing silicone oil and generating heat. The heat is transmitted to the coolant flowing in the heat exchange chamber 8 through the partition 2. The heated coolant is sent from the outlet port 10 to the heating circuit 32 for heating the passenger compartment.

A method for manufacturing the outer rotor 14 will now be described. The inner rotor 13 is made of iron or iron alloy, which have a relatively small coefficient of thermal expansion. The outer rotor 14 is made of aluminum or aluminum alloy, which have relatively large coefficients of thermal expansion. Accordingly, when the outer rotor 14 and the inner rotor 13 are heated equally, the outer rotor 14 expands more than the inner rotor 13. When the outer rotor 14 and the inner rotor 13 are equally cooled, the outer rotor 14 contracts more than the inner rotor 13.

In a first step, the inner rotor 13 is manufactured. In this step, the inner rotor 13 is roughly formed.

In a second step, the inner rotor 13 is set in a casting mold for the outer rotor 14 such that the inner rotor 13 will be positioned at the center of the outer rotor 14.

In a third step, a molten aluminum or a molten aluminum alloy is poured into the casting mold. The temperature of the molten aluminum or the molten aluminum alloy is about 850 degrees Celsius.

In a fourth step, the casting mold is removed after cooling down. The outer rotor 14 and the inner rotor 13 are cooled from about 850 degrees Celsius to a room temperature. The outer rotor 14 contracts more than the inner rotor 13 in accordance with the difference of the thermal expansion coefficient. This causes the boss 15 to tighten about the inner rotor 13. Therefore, the outer rotor 14 is firmly secured to the inner rotor 13.

In a fifth step, the integrally formed inner rotor 13 and the outer rotor 14 are ground to fit the heater.

The tightening force of the outer rotor 14 against the inner rotor 13 will now be described. FIG. 3 conceptually shows the relation between the expansion amount of medium carbon steel (S45C) and aluminum alloy (ADC12) with respect to temperature. The thermal expansion coefficient of medium carbon steel (S45C) is $10.7*10^{-6}$ [$K^{-1}$], and the thermal expansion coefficient of the aluminum alloy (ADC12) is $21.0*10^{-6}$ [$K^{-1}$].

Suppose that steel S45C and aluminum alloy ADC12 are heated from a room temperature (RT) to be 850 degrees Celsius. At room temperature, the expansion amounts of the steel S45C and the aluminum alloy ADC12 are zero (S1 is a starting point). When the temperature reaches 850 degrees Celsius, the expansion amount of the steel S45c is P1 (S2 is a terminal point), and the expansion amount of the aluminum alloy ADC12 is P2 (S2' is a terminal point). When two parts having different thermal expansion coefficients are heated, the difference of their expansion amounts (P1–P2) is indicated as a clearance K1.

On the other hand, in the third step casting, the medium carbon steel and the aluminum alloy have the same temperature 850 degrees Celsius, and it is supposed that both metals are at a starting point of S2. In the period from the third step to the fourth step, both metals are cooled from 850 degrees Celsius to room temperature (RT). This is a cooling step having S2 as the common starting point. That is, as the temperature decreases, the expansion amount of S45C changes from S2 to S1. This change is the reverse of that when heating occurs. On the other hand, as the temperature decreases, the expansion amount of the aluminum alloy ADC12 changes from S2 to S1'. The line S2–S1' is parallel to the heating line S1–S2'. When reaching the room temperature (RT), the steel S45C has been contracted by the amount P1. On the other hand, the aluminum alloy ADC12 has been contracted by the amount P1 plus P3.

In this way, both the medium carbon steel and the aluminum alloy contract when cooled and the aluminum alloy ADC12 contracts more than the steel S45C by K2. K2 is essentially an interference of one member with another member when two members having different thermal expansion coefficients are cooled from a high temperature to a low temperature. A force corresponding to K2 is applied from the outer rotor 14 to the inner rotor 13.

The outer rotor 14, which is made of aluminum or aluminum alloy, is formed on the iron or iron alloy inner rotor 13 by casting, which tightens the outer rotor 14 against the inner rotor 13 with substantial force. As a result, slippage between the outer rotor 14 and the inner rotor 13 is prevented.

Since the outer rotor 14 is formed on the inner rotor 13 by casting, the problem in the prior art of cracking or breaking the outer rotor 14 during insertion is avoided. Therefore, the length of the contacting part between the outer rotor 14 and the inner rotor 13 can be relatively long. Accordingly, the outer rotor 14 is firmly secured to the inner rotor 13 and torque is uniformly transmitted from the inner rotor 13 to the outer rotor 14. This allows the boss 15 to be thinner.

The projections 18 are integrally formed on the inner rotor 13. Since the outer rotor 14 is cast to contact the projections 18, the rotor does not move with respect to the inner rotor 13 when heated. Also, the clearance 17 between the inner wall of the heating chamber 7 and the outer surface of the cylindrical portion 16 does not vary. Accordingly, the heater maintains a high heat generation efficiency.

The first embodiment can be varied as follows.

Grooves may be formed instead of the projections 18 on the inner rotor 13. The inner rotor 13 may have a rough surface.

The six projections 18 may be omitted or the number of the projections 18 may be changed.

In the manufacturing method of the outer rotor 14, pressure may be applied in the third step. In this case, the size of bubbles produced when the molten metal is solidifying is decreased, thus improving the strength of the outer rotor 14.

Figure 4:
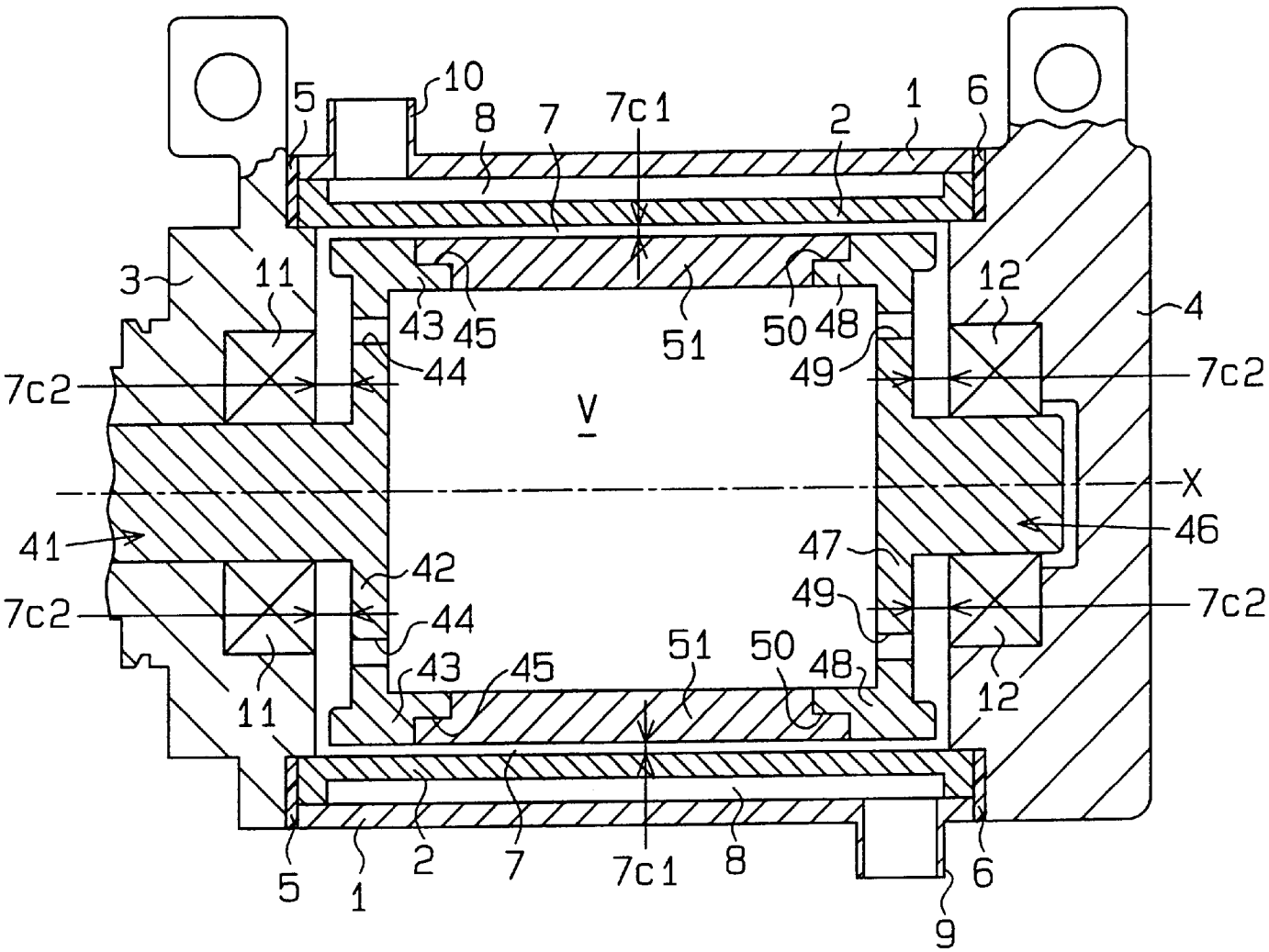
FIG. 4 is a partial cross sectional view of a heater according to a second embodiment of the present invention.
Figure 5:
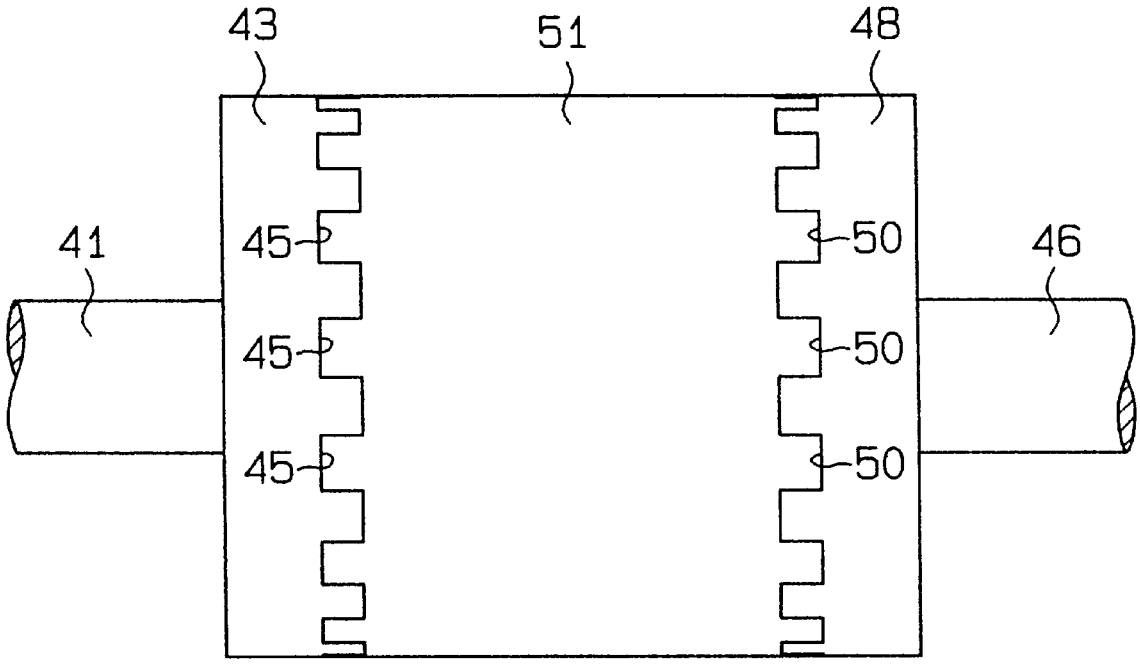
FIG. 5 is a plan view of the rotor of FIG. 4.

FIGS. 4 and 5 shows a heater according to a second embodiment. In this heater, the structure of the rotors is different from that of the first embodiment. The second embodiment will now be described, concentrating on the difference.

As shown in FIG. 4, a front drive shaft, or inner rotor 41, is rotatably supported in the front housing 3 through the bearing 11, which has a seal. The front inner rotor 41 includes a front disc 42 and a rim 43, which are located in the heating chamber 7. The front disc 42 extends radially from the rear end of the front inner rotor 41. Front through holes 44 are formed in the front disc 42. The rim 43 extends rearward from the periphery of the front disc 42. Notches 45 are formed on the rim 43 at certain intervals.

A rear inner rotor 46 is rotatably supported in the rear housing 4 through the sealed bearing 12. The rear inner rotor 46 includes a rear disc 47 and a rim 48, which are located in the heating chamber 7. The rear disc 47 extends radially from the front end of the rear inner rotor 46. Rear through holes 49 are formed in the rear disc 47. The rim 48 extends frontward from the periphery of the rear disc 47. Notches 50 are formed on the periphery of the rim 48 at certain intervals. The front inner rotor 41 and the rear inner rotor 46 are coaxial with a rotation axis X.

As shown in FIG. 4, a cylinder, or outer rotor 51, is held between the inner rotors 41, 46. The ends of the outer rotor 51 engage the rims 43, 48. The outer rotor 51 and the front and rear inner rotors 41, 46 form a rotor assembly. The circumferential surface of the outer rotor 51 is flush with those of the front and rear rims 43, 48. The shape of the rotor assembly corresponds to the internal shape of the heating chamber 7. The rotor assembly is spaced from the inner wall of the heating chamber 7 by a clearance **7*c*1. The clearance 7*c*1** is in the range of $10\mu$ to 1 mm.

A clearance **7*c*2 is formed between the front surface of the front disc 42 and the inner wall of the heating chamber 7. A clearance 7*c*2 is also formed between the rear surface of the rear disc 47 and the inner wall of the heating chamber 7. The clearance 7*c*1 is much narrower than the clearances 7*c*2. Therefore, the fluid friction of silicone oil in the clearance 7*c*1 mostly generates heat. On the other hand, little heat is generated in the clearances 7*c*2** since there is little fluid friction.

In the heating chamber 7, a reservoir V is defined in the rotor, that is, a space surrounded by the rear surface of the front disc 42, the front surface of the rear disc 47, and the inner walls of the outer rotor 51.

The outer rotor 51 is formed between the front inner rotor 41 and the rear inner rotor 46 by casting. Therefore, the outer rotor 51 and the front and rear inner rotors 41, 46 are fixed together, and they integrally rotate.

The manufacturing method of the rotor assembly will now be explained. In the second embodiment, a lost wax process is employed. The front and rear inner rotors 41, 46 are made of iron or iron alloy. The outer rotor 51 is made of aluminum or aluminum alloy.

In a first step, the front and rear inner rotors 41, 46 are manufactured. In this step, the inner rotors 41, 46 are roughly formed.

In a second step, the inner rotors 41, 46 are placed in a predetermined position of a mold for the outer rotor 51. In this state, a wax core is placed between the front and rear rims 43, 48.

In a third step, a molten aluminum or a molten aluminum alloy is poured into the mold. The temperature of the molten aluminum or aluminum alloy is about 850 degrees Celsius. In the mold, the molten aluminum or aluminum alloy is cooled by the waxed core and solidifies. On the other hand, the wax core is melted.

In a fourth step, the mold is removed when cooled. The outer rotor 51 is integrally formed with the inner rotors 41, 46. When cooled, the outer rotor 51 contracts more than the inner rotors 41, 46 in accordance with the difference of thermal expansion coefficient. This causes the outer rotor 51 to tighten against the inner rotors 41, 46.

In a fifth step, the integrally formed outer rotor 51 and the inner rotors 41, 46 are ground to fit the heater.

The second embodiment has the following advantages.

Since the outer rotor 51 is tightened against the front and rear inner rotors 41, 46, slippage between the rotor and the drive shaft is prevented.

Many notches 45, 50 are formed on the front and rear inner rotors 41, 46. The outer rotor 51 engages the notches 45, 50 when cast and is thus firmly secured to the inner rotors 41, 46. Accordingly, the clearances 7*c*1, 7*c*2 do not vary, which maintains the heat-generation efficiency.

When the rotor assembly rotates, silicone oil is supplied from the reservoir V to the clearance 7*c*1 through the through holes 44, 49. Then, the silicone oil is returned from the clearance 7*c*1 to the reservoir V through the holes 44, 49. This circulation of silicone oil prevents localized over-shearing of the silicone oil, which extends the useful life of the oil.

The large space inside the rotor assembly is used as a reservoir V for silicone oil. Accordingly, a great amount of silicone oil is accommodated in the reservoir V, thus reducing deterioration of the oil. Therefore, the capacity of the heater is maintained for a long time.

In the second embodiment, the notches 45, 50 may be omitted.

Figure 6:
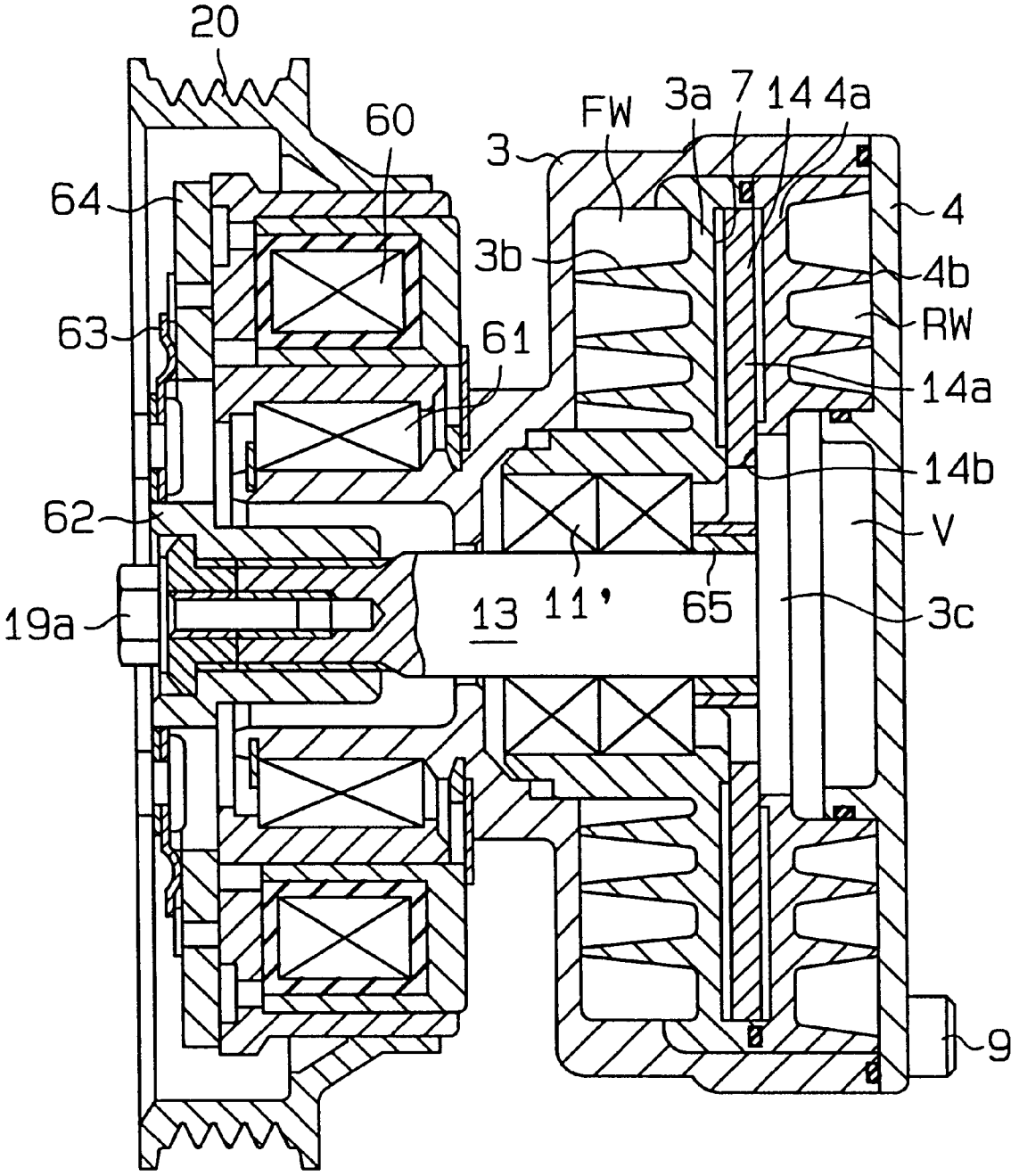
FIG. 6 is a cross sectional view of a heater according to a third embodiment of the present embodiment.
Figure 7A:
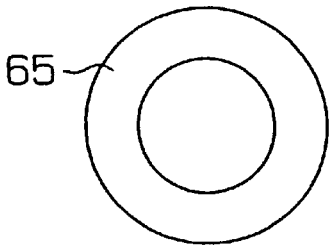
FIG. 7*a* is a plan view of the bushing of FIG. 6.
Figure 7B:
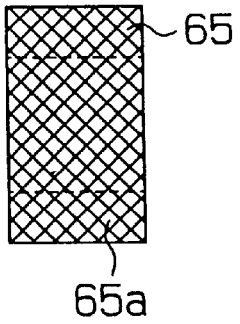
FIG. 7*b* is a side view of the bushing of FIG. 6.
Figure 8:
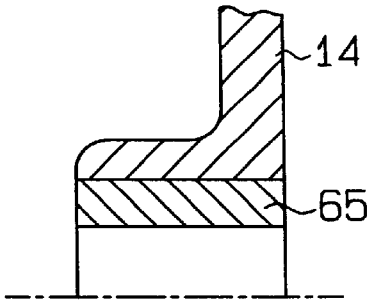
FIG. 8 is an enlarged cross sectional view of the bushing and the rotor of FIG. 6.

FIGS. 6 to 8 show a heater according to a third embodiment. As shown in FIG. 6, the heater includes a front housing 3, a front plate 3*a*, a rear plate 4*a*, and a rear housing 4. The front housing 3, the front plate 3*a*, the rear plate 4*a*, and a rear housing 4 are sealed with O-rings and fastened by bolts 9. A heating chamber 7 is defined by the rear surface of the front plate 3*a* and the front surface of the rear plate 4*a*. A reservoir V is defined by the rear plate 4*a* and the rear housing 4. The heating chamber 7 and the reservoir V constitute an operating chamber.

Arcuate fins 3*b* project from the front surface of the front plate 3*a*. The front housing 3 and the fins 3*b* form a front water jacket FW. Arcuate fins 4*b* project from the rear surface of the rear plate 4*a*. The rear housing 4 and the fins 4*b* form a rear water jacket RW. The engine coolant flows in the front and rear water jackets FW, RW along the fins 3*b*, 4*b*. The fins 3*b*, 4*b* increase the area of heat transfer from the heating chamber to the coolant. The front and rear water jackets FW, RW are served as a heat exchange chamber.

A sealed bearing 11' is arranged in the shaft hole in the front plate 3*a* to support a rotor assembly 14. A drive shaft, or inner rotor 13, is rotatably supported by the bearing 11'. In the rotor assembly 14, an outer rotor, or disc 14*a*, is attached to the rear end of the inner rotor 13. The outer rotor 14*a* rotates in the heating chamber 7.

The inner rotor 13 is made of iron or iron alloy (structural carbon steel). The rotor 13 includes a sleeve, or intermediate rotor 65. The outer rotor 14*a* is cast on the intermediate rotor 65. Through holes 14*b* are formed in the outer rotor 14*a* in the vicinity of the intermediate rotor 65. The outer rotor 14*a* is made of aluminum or aluminum alloy. The intermediate rotor 65 is made of iron or iron alloy (structural carbon steel). As shown in FIG. 7*b*, the intermediate rotor 65 has a knurled surface 14*c*.

The manufacturing method of the outer rotor assembly 14 is similar to those of the first and second embodiments.

In a first step, the knurled intermediate rotor 65 is manufactured. In a second step, the intermediate rotor 65 is placed in a predetermined position in a mold. In a third step, molten aluminum is poured into the mold. In a fourth step, the mold is removed when cooled. In a fifth step, finishing work is performed on the outer rotor assembly 14. The finishing work includes drilling, cutting, and grinding. In this way, a sub-assembly of the outer rotor 14*a* and the intermediate rotor 65 is manufactured.

As shown in FIG. 6, the sub-assembly is press-fitted on the inner rotor 13. Since the intermediate rotor 65 has a predetermined interference with the inner rotor 13, the outer rotor 14*a* rotates integrally with the inner rotor 13.

The reservoir V accommodates more silicone oil than the heating chamber 7. The silicone oil occupies forty to seventy percent of the volume of the heating chamber 7 and the reservoir V. A through hole 3*c* is formed in the center of the rear plate 4*a* to connect the reservoir V with the heating chamber 7. The silicone oil circulates between the reservoir V and the heating chamber 7 via the through hole 3*c*.

An electromagnetic clutch mechanism is attached to the front housing 3 and the inner rotor 13. The pulley 20 is rotatably supported in the front housing 3 through a bearing 61. The clutch mechanism includes an excitation coil 60, which is located in the pulley 20. The excitation coil 60 is connected to an ECU (electronic control unit) of an air conditioner (not shown). A hub 62 is fixed to the inner rotor 13 by a bolt 19*a*. The hub 62 is fixed to an armature 64 through a plate spring 63. The pulley 20 is rotated by a vehicle engine (not shown) through a belt.

In the third embodiment, the ECU excites the excitation coil 60 to attract the armature 64, thus connecting the pulley 20 to the inner rotor 13 of the rotor assembly 14. The rotor assembly 14 shears the silicone oil and generates heat. The heat is transmitted to the coolant in the front and rear water jackets FW, RW and the coolant circulates in the heating circuit.

While the rotor assembly 14 is rotating, the torque from the inner rotor 13 is transmitted to the outer rotor 14*a* through the intermediate rotor 65. The thermal expansion coefficient of the inner rotor 13 is substantially the same as that of the intermediate rotor 65. Therefore, a temperature change does not vary the tightening force of the intermediate rotor against the inner rotor 13. Therefore, the intermediate rotor 65 integrally rotates with the inner rotor 13 without slipping. As described with respect to the first embodiment, since the aluminum disc, or outer rotor 14*a* is integrally cast on the iron sleeve, or intermediate rotor 65, the outer rotor 14*a* is firmly secured to the intermediate rotor 65. Accordingly, the outer rotor 14*a* integrally rotates with the intermediate rotor 65 without slipping. Further, since the knurled surface 65*a* is formed on the peripheral surface of the intermediate rotor 65, the coupling between the outer rotor 14*a* and the intermediate rotor 65 is mechanically strengthened for torque transmission and against axial slippage. As a result, the driving force is positively transmitted from the inner rotor 13 to the outer rotor 14*a* through the intermediate rotor 65, which prevents slippage between the outer rotor 14*a* and the inner rotor 13 and maintains the efficiency of the heater.

The third embodiment has the following advantages, in addition to the advantages of the first and second embodiments.

Since the knurled surface 65*a* is formed on the outer surface of the intermediate rotor 65, the mechanical coupling between the intermediate rotor 65 and the outer rotor 14*a* is strengthened for torque transmission and against axial slippage. Accordingly, axial movement of the outer rotor 14*a* with respect to the intermediate rotor 65 is prevented and damage to the outer rotor 14*a* resulting from contact with the inner wall of the heating chamber 7 is prevented.

Since the outer rotor 14*a* is cast on the intermediate rotor 65, couplers such as the prior art rivets are unnecessary, thus reducing the number of parts.

Since sub-assembly 14*a*, 65 is fitted onto the inner rotor 13, as in the prior art, there is no further assembly step required.

Figure 9A:
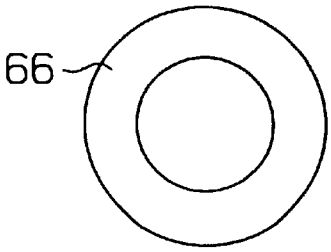
FIG. 9*a* is a plan view of a bushing according to a fourth embodiment of the present invention.
Figure 9B:
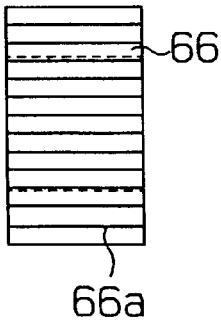
FIG. 9*b* is a side view of the bushing of FIG. 9*a;*

FIGS. 9*a* and 9*b* show a sleeve, or intermediate rotor 66, used for a heater according to a fourth embodiment. Splines 66*a*, which extend axially, are formed on the outer surface of the intermediate rotor 66. In the fourth embodiment, the coupling of the outer rotor 14*a* and the intermediate rotor 66 is strengthened primarily for torque transmission. In other respects, the fourth embodiment has the same advantages as the third embodiment.

Figure 10A:
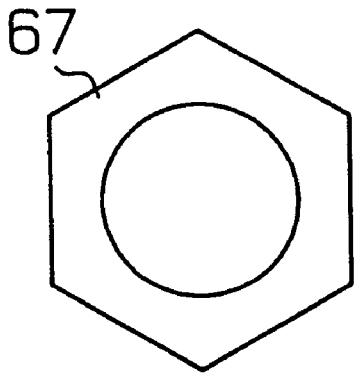
FIG. 10*a* is a plan view of a bushing according to a fifth embodiment of the present invention.
Figure 10B:
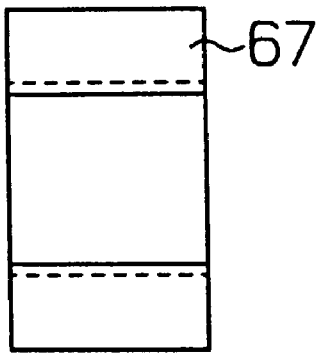
FIG. 10*b* is a side view of the bushing of FIG. 10*a;*

FIGS. 10*a* and 10*b* show a sleeve, or intermediate rotor 67, used in a heater according to a fifth embodiment. The intermediate rotor is hexagonal. Accordingly, the coupling between the outer rotor 14*a* and the intermediate rotor 67 is strengthened primarily for torque transmission. In other respects, the fifth embodiment has the same advantages as the third embodiment.

Figure 11A:
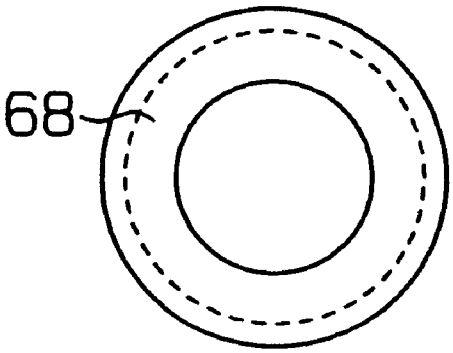
FIG. 11*a* is a plan view of a bushing according to a sixth embodiment of the present invention.
Figure 11B:
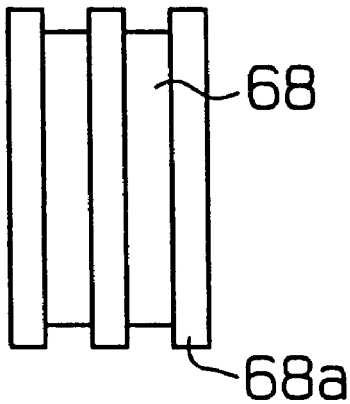
FIG. 11*b* is a side view of the bushing of FIG. 11*b*.

FIGS. 11*a* and 11*b* show a sleeve, or intermediate rotor 68, used in a heater according to a sixth embodiment. The intermediate rotor includes three flanges 68*a*, which extend radially. Accordingly, the coupling between the outer rotor 14*a* and the intermediate rotor 68 is strengthened primarily against axial slippage. In other respects, the sixth embodiment has the same advantages as the third embodiment.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A method for producing a rotor assembly for a heat generator, wherein the heat generator includes a first rotor, a second rotor, the second rotor being rotated integrally with the first rotor, and viscous fluid, wherein the first and second rotors rotate to shear the viscous fluid to heat the viscous fluid, the method comprising the steps of:

forming the first rotor from a first material; and casting the second rotor by a second material around the first rotor, wherein the second material has a thermal expansion coefficient greater than that of the first material.

2. The method according to claim 1, wherein the first rotor is located at the center of the second rotor in the casting step.

3. The method according to claim 1, wherein the first rotor includes a pair of drive shafts located concentrically, wherein the casting step includes casting the second rotor between the pair of drive shafts by a lost-wax process.

4. The method according to claim 1, wherein the first rotor includes a drive shaft, an intermediate rotor, which is fitted to the drive shaft, wherein the thermal expansion coefficient of the material of the intermediate rotor is substantially equal to that of the drive shaft, and wherein the casting step includes casting the second rotor with the intermediate rotor.

5. The method according to claim 4 further comprising press-fitting the intermediate rotor to the drive shaft after casting the second rotor to the intermediate rotor.

6. A rotor assembly for shearing viscous fluid to heat the viscous fluid in a heat generator, wherein the heat generator has a housing and a heating chamber defined in the housing, wherein the heating chamber accommodates the rotor assembly and the viscous fluid, the rotor assembly comprising:

a first rotor made of a first material;

a second rotor integrally attached with the first rotor by casting, wherein the second rotor is made of a second material which has a thermal expansion coefficient greater than that of the first material.

7. The rotor assembly according to claim 6, wherein the first rotor includes a pair of coaxial drive shafts, wherein the second rotor is fixed between the drive shafts by casting.

8. The rotor assembly according to claim 6, wherein the first rotor includes a drive shaft, a sleeve, which is press-fitted to the drive shaft, wherein the second rotor is cast on the sleeve.

9. The rotor assembly according to claim 8, wherein the sleeve has a rough outer peripheral surface, and the second rotor contacts the rough surface.

10. The rotor assembly according to claim 9, wherein the rough surface is formed by a plurality of grooves, which intersect each other.

11. The rotor assembly according to claim 8, wherein the sleeve has an annular groove formed in its outer peripheral surface.

12. The rotor assembly according to claim 8, wherein a portion of the outer surface of the sleeve is planar.

13. The rotor assembly according to claim 6, wherein the first material is iron or iron alloy, wherein the second material is aluminum or aluminum alloy.

14. A heat generator comprising:

a housing;

a heating chamber defined in the housing;

viscous fluid accommodated in the heating chamber; and a rotor assembly for shearing the viscous fluid to heat the viscous fluid, wherein the rotor assembly includes:

a first rotor made of a first material; and a second rotor integrally attached to the first rotor by casting, wherein the second rotor is made of a second material which has a thermal expansion coefficient greater than that of the first material.

15. The heat generator according to claim 14, wherein the first rotor includes a pair of coaxial drive shafts, wherein the second rotor is fixed between the drive shafts by casting.

16. The heat generator according to claim 14, wherein the first rotor includes a drive shaft, a sleeve, which is press-fitted to the drive shaft, wherein the second rotor is cast on the sleeve.

17. The heat generator according to claim 16, wherein the sleeve has a rough outer peripheral surface, and the second rotor contacts the rough surface.

18. The heat generator according to claim 17, wherein the rough surface is formed by a plurality of grooves, which intersect each other.

19. The heat generator according to claim 16, wherein the sleeve has an annular groove formed in its outer peripheral surface.

20. The heat generator according to claim 16, wherein a portion of the outer surface of the sleeve is planar.

21. The heat generator according to claim 14, wherein the first material is iron or iron alloy, wherein the second material is aluminum or aluminum alloy.

22. A method for producing a rotor assembly for a heat generator, wherein the heat generator includes an inner rotor, an outer rotor, the outer rotor being rotated integrally with the inner rotor, and viscous fluid, wherein the outer rotor rotates to shear the viscous fluid to heat the viscous fluid, the method comprising the steps of:

forming the inner rotor from a first material; and uniformly casting the outer rotor by a second material on the inner rotor, wherein the second material has a thermal expansion coefficient greater than that of the first material.

23. The method according to claim 22, wherein the inner rotor is located at the center of the outer rotor in the casting step.

24. A method for producing a rotor assembly for a heat generator, wherein the heat generator includes a drive shaft, a sleeve, which is fitted to the drive shaft, a disk rotor, the disk rotor being rotated integrally with the drive shaft and the sleeve, and viscous fluid, wherein the disk rotor rotates to shear the viscous fluid to heat the viscous fluid, the method comprising the steps of:

first forming the drive shaft from a first material;

second forming the sleeve from a second material, wherein the second material has a thermal expansion coefficient substantially equal to that of the first material;

casting the disk rotor by a third material on the sleeve, wherein the third material has a thermal expansion coefficient greater than those of the first material and the second material; and press-fitting the sleeve to the drive shaft.

25. The method according to claim 24, wherein the second forming step includes knurling an outer surface of the sleeve.

26. The method according to claim 24, wherein the second forming step includes forming splines, which extend axially, on an outer surface of the sleeve.

27. The method according to claim 24, wherein the second forming step includes forming flanges, which extend radially from an outer surface of the sleeve.

28. The method according to claim 24, wherein the second forming step includes forming a planar portion on its outer surface of the sleeve.

* * * * *